United States Patent [19]

Dietrich et al.

[11] 4,012,664

[45] Mar. 15, 1977

[54] IGNITION ARRANGEMENT FOR AN ELECTRONIC FLASHTUBE

[75] Inventors: Rolf Dietrich, Hofheim; Egon Gahler, Frankfurt-Zeilsheim, both of Germany

[73] Assignee: Braun Aktiengesellschaft, Kronberg, Germany

[22] Filed: Sept. 25, 1975

[21] Appl. No.: 616,814

[52] U.S. Cl. ..... 315/241 P; 307/252 J; 315/151; 315/335; 315/340

[51] Int. Cl.[2] ..... H05B 41/32

[58] Field of Search ..... 315/241 P, 151, 185 R, 315/188, 193, 335, 340; 354/145; 307/252 J

[56] References Cited

UNITED STATES PATENTS

| | | | |
|---|---|---|---|
| 3,809,951 | 5/1974 | Vital et al. | 315/159 X |
| 3,864,600 | 2/1975 | Schneider | 315/241 P |
| 3,890,536 | 6/1975 | Iwata | 315/151 |

*Primary Examiner*—Eugene R. LaRoche
*Attorney, Agent, or Firm*—Richard A. Wise; Oistein J. Bratlie; Raymond J. Devellis

[57] ABSTRACT

A circuit for igniting an electronic flashtube including a thyristor connected in series with the flashtube and an ignition capacitor connected through a switching thyristor to an ignition transformer to trigger the flashtube. The state of the series thyristor is controlled by means such as an electronic threshold switch to provide proper switching operation over a range of flashtubes with different specimen variations with respect to the time required to build up plasma.

8 Claims, 3 Drawing Figures

IGNITION ARRANGEMENT FOR AN ELECTRONIC FLASHTUBE

BACKGROUND OF THE INVENTION

This invention relates to circuitry utilized in an electronic flash units normally associated with the photographic arts.

More particularly, this invention relates to circuitry providing an ignition arrangement for an electronic flashtube which allows reliable operation of flashtubes which may take different amounts of time to build up the required plasma due to specimen variations.

Electronic flash units typically include a flash device such as a flashtube, a storage means such as a storage or flash capacitor connected across the flashtube and an ingnition circuit typically comprising a switching thyristor, ignition capacitor and ignition transformer to fire or trigger the flashtube. A thyristor placed in series with the flash tube is provided as part of automatic termination circuitry of the flashtube to prevent the full discharging of the storage capacitor between operations, all as well known in the art. An example of such automatic termination circuitry is using light reflected from the subject being photographed to terminate the flash.

Flash units of the type just described have the difficulty in that presently available flashtubes are subject to severe specimen variations with respect to the time required to build up plasma. Thus, it is possible that one flashtube requires only 10 microseconds to build up the plasma while another becomes fully conductive only after 100 microseconds. In order to provide sufficient ignition of the flashtube, the series thyristor must be made conductive by a switching pulse at its control electrode or gate by means such as the discharge of a control capacitor. This switching pulse should be maintained until the so-called "latching current" is attained. When the switching pulse is then switched off, conductivity is automatically maintained in this series thyristor until the line voltage once again crosses zero. The "latching current" is defined as the minimum current required to sustain conduction immediately after the thyristor is switched from the "off" to the "on" state and the switching or gate signal is removed.

If the length of the switching pulse were scaled for a flashtube which takes 10 microseconds to build up the plasma, then a flashtube which takes 100 microseconds to build up the plasma would not be able to reach ignition. On the other hand, if the control capacitor was adapted for a 100 microsecond flashtube, then difficulties arise within the proximity region when flashtubes are regulated according to light quantity. That is, with a fast flashtube, the extinction or quenching pulse already runs through the series thyristor typically after 30 or 40 microseconds. Thus, such an extinction pulse would not lead to charge extinction when the switching pulse from the control capacitor is applied for another 50 microseconds to the gate of the series thyristor.

The advantage of creating an ignition arrangement which removes switching uncertainties arising from specimen variations in the plasma buildup time of flashtubes has been provided by establishing an electrical connection between the ignition circuit and the gate of the series thyristor through an electronic threshold switch. The electrode which controls the electronic threshold switch is connected to a switching element which changes its terminal voltage by means such as the current through the flashtube. Thus, the threshold of the threshold switch may be chosen to conduct for a predetermined time after the current is reached which corresponds to the latching current or the like.

SUMMARY OF THE INVENTION

It is an object of this invention to provide circuitry in a flash unit which uses driving power to drive a series thyristor only when the plasma in the flashtube is sufficient to secure firing of the flashtube and of the series thyristor.

It is also an object of this invention to provide a flash unit which uses as a switching element an impedance such as a resistance through which flows the current from the flashtube.

It is another object of this invention to provide a flash unit which determines the control time through a resistor-capacitor time constant connected to the electronic threshold switch.

It is still another object of this invention to provide a flash unit in which the series thyristor is bridged by an impedance, one of whose terminals has a voltage sufficient to control the electronic threshold switch when the current through the flashtube corresponds to the latching current of the series thyristor.

Briefly stated and according to one aspect of this invention, the foregoing objects are achieved by providing a flash unit having an ignition arrangement for an electronic flashtube which includes a threshold switch and means to control the biasing of the threshold switch.

BRIEF DESCRIPTION OF THE DRAWINGS

The invention both as to its organization and principles of operation together with further objects and advantages thereof may better be understood by referring to the following detailed description of embodiments of the invention when taken in conjunction with the accompanying drawing in which.

DESCRIPTION OF A PREFERRED EMBODIMENT

Figure 1:
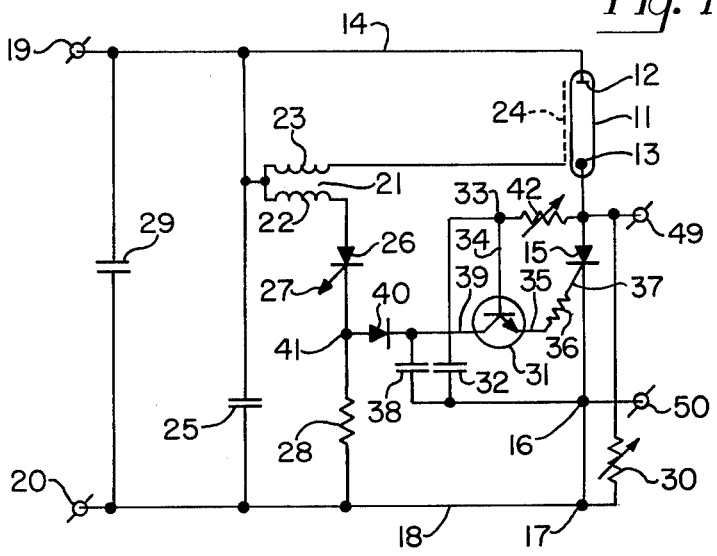
FIG. 1 is a circuit diagram of an ignition arrangement for a flashtube which applies a switching pulse to the gate of a series thyristor when the current through the flashtube corresponds to the latching current of the series thyristor, in accordance with this invention.

Referring now to FIG. 1, there is shown circuitry which operates as a flash unit including a flash device or flashtube 11 having a first electrode 12 and second electrode 13 included therein. First electrode 12 is connected to an upper conductor 14 and second electrode 13 is connected to the anode of a series thyristor 15. The cathode of the series thyristor 15 is in turn connected in series through connection point 16 to connection point 17 which again in turn in connected to lower conductor 18. Upper conductor 14 and lower conductor 18 are respectively connected to terminals 19 and 20 which are adapted to receive energization from any suitable source of potential (not shown) in a manner well known in the art.

Triggering circuitry for the flashtube 11 include a step up or ignition transformer 21 having a primary winding 22 and a secondary winding 23. The output of the secondary winding 23 is connected to a triggering or outer electrode 24 of the flashtube 11. Connected between lower conductor 18 and a first side primary winding 22 is an ignition capacitor 25. Connected to the second side of the primary winding 21 is the anode of a switching thyristor 26 having a control electrode or gate 27. The cathode of the switching thyristor 26 is in turn connected to cathode resistor 28 which in turn is connected to lower conductor 18. Connected between upper conductor 14 and lower conductor 18 is a flash or storage capacitor 29.

In operation, primary winding 22 of transformer 21 will receive its excitation when the switching thyristor 26 receives the proper control signal at gate 27. Gate 27 is typically connected to the shutter switch or the like of an associated camera. This allows ignition capacitor 25 to discharge across primary winding 22 thereby activating transformer 21 and trigger electrode 24 which along with storage capacitor 29 triggers flashtube 11, i.e. initiates plasma buildup. Storage capacitor 29 when fully charged will not "fire" flashtube 11, but will apply a voltage to the flashtube 11 equal to its charged value. The voltage from the storage capacitor 29 and the ignition capacitor 25, when switching thyristor 26 is in its conductive state, causes the flashtube 11 to fire providing sufficient plasma build-up time has occurred. Even though series thyristor 15 is in a non-conducting or "off" state, some current will still flow there through to allow the voltage of storage capacitor 29 along with the voltage from the ignition capacitor 25 thereby causing a current to flow from the flashtube 11.

Connected between the anode of the series thyristor 15 and connecting point 17 is a metering resistor 30. Metering resistor 30 is, in a preferred embodiment, adjustable and chosen to be of a resistance so that a current corresponding to the latching current of the series thyristor 15 generates a voltage at connection point or voltage carrying terminal 17. This voltage will just exceed the threshold of an electronic threshold switch or transistor 31. Voltage carrying terminal 17 is electrically connected through connection point 16 and capacitor 32 and connection point 33 to the control electrode or base 34 of threshold switch 31. The emitter 35 of switch 31 is electrically connected through a resistor 36 to the control electrode or gate 37 of the series thyristor 15.

Thus, when the predetermined voltage at voltage carrying terminal 17 is reached, the threshold switch 31 is rendered conductive and an electrical connection is made between a control capacitor 38, electrically connected to the collector 39 of switch 31 and connection point 16, to apply its voltage through resistor 36 and gate 37 to render series thyristor 15 conductive. The control capacitor 38 is continually charged through a diode 40, which in turn is electrically connected between the cathode of switching thyristor 26 and resistor 28 at connection point 41, when the ignition capacitor 25 is discharged, i.e. at the same time the flashtube 11 is ignited. The control capacitor 38 is selected so that it maintains the electronic threshold switch 31 in an "on" or conducting state until the latching current of the series thyristor 15 has certainly been reached through the flash discharge current.

The metering resistor 30 bridges the series thyristor 15 and connection point 17 develops a voltage sufficient to control the electronic threshold switch 31, when the current through the flashtube corresponds to the latching current of the series thyristor 15. When this voltage is reached, the voltage from the control capacitor 38, which is connected through the electronic threshold switch 31 to the gate 37 of the series thyristor 15, provides a switching signal thereto. In this embodiment, the plasma in the flashtube 11 determines when the series thyristor begins to be driven. The duration of drive is thus determined by the size of the control capacitor 38 which serves as a drive voltage source. Thus, the latching current can safely be exceeded without over-illumination possibly occurring in the proximity region, when the system is used in flash devices which are regulated according to light quantity. This embodiment, can, as discussed previously, be improved by utilizing an adjustable impedance in the form of adjustable resistor 30. If this is accomplished, the threshold value of the electronic threshold switch 31 can readily be set to the latching current of the series thyristor 15.

If metering resistor 30 cannot be readily utilized because of any associated circuit used, the current flow from second electrode 13 of the flashtube 11 through a base resistor 42, electrically connected between second electrode 13 and the base 34 of the switch 31, will be sufficient to turn on the threshold switch 31. The base resistor 42 is in a preferred embodiment designed as a variable or adjustable resistor.

In total operation, when a switching pulse is conducted to the gate 27 of the switching thyristor 26, the ignition capacitor 25 discharges through the ignition transformer 21 and the cathode resistor 28. A voltage impulse is thus generated in the outer electrode 24 of the flashtube 11. Through this voltage impulse, a plasma forms in the flashtube 11 so that the latter becomes conducting over a period from about 10 to 100 microseconds depending upon specimen variations. In this time a plasma develops in the flashtube 11 and leads to a steep rise in conductivity toward the end of the development. The conductivity rise leads to a current rise, and the latter results in a voltage rise at the metering resistor 30, which typically is of a relatively high ohm rating. The metering resistor 30 is chosen so that the current corresponding to the latching current of the series thyristor 15 generates a voltage at the voltage carrying terminal 17 of the metering resistor 30. This voltage just exceeds the threshold of the control of base electrode 34 of the switch 31. Thus, the electronic threshold switch 31 becomes conducting and the gate 37 of series thyristor 15 is connected to the control capacitor 38.

Figure 2:
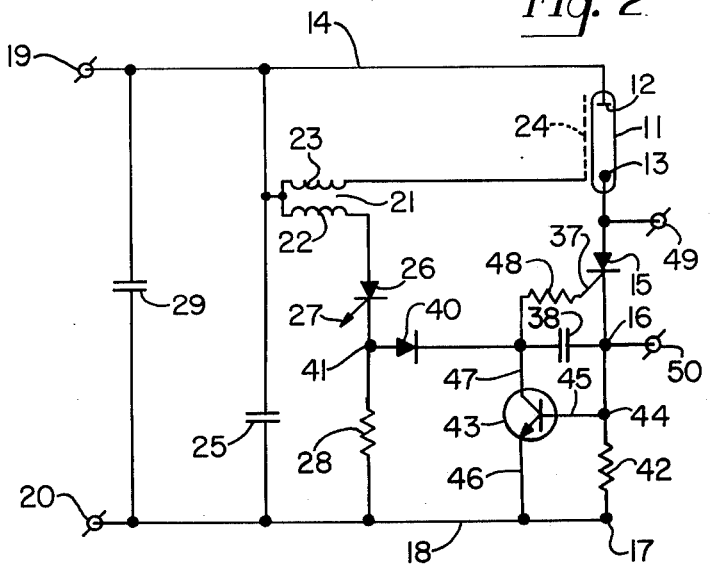
FIG. 2 is a circuit diagram of an ignition arrangement for a flashtube which provides a switching pulse to the gate of a series thyristor substantially immediately and removes the switching pulse in response to a predetermined amount of flashtube current corresponding to a buildup of discharge in the flashtube, in accordance with this invention.

Referring now to FIG. 2 with the common numbered elements having the functions as described in FIG. 1, the arrangement according to FIG. 1 is modified in a way such that the control capacitor 38 bridges a series resistor 42 over an electronic threshold switch 43. In this embodiment the series resistor 42 is connected through connection point 44 to the control electrode or base 45 of switch 43 and in series with series thyristor 15. The emitter 46 of switch 43 is connected to lower conductor 18 and the collector 47 of switch 43 is connected between diode 40 and capacitor 38.

In this embodiment of the invention, the driving energy in the control capacitor 38 is cancelled when a sufficiently high discharge current, exceeding the latching current, has formed.

In operation when ignition takes place in the ignition circuit comprising switching thyristor 26, ignition capacitor 25, ignition transformer 21, voltage terminal point 41 and resistor 28, the control capacitor 38 is charged through diode 40. However, series thyristor 15 is here immediately fired through a protective resistor 48 designed to protect thyristor 15. If the current from the flashtube 11 through resistor 42 has grown sufficiently, the voltage of the control electrode or base 45 of the threshold switch 43 exceeds the threshold voltage. Then the threshold switch 43 turns on and thus discharges the control capacitor 38 and negatively charges the series thyristor 15 through its control electrode or gate 37.

Terminals 49 and 50 are electrically connected across the series thyristor 15 and may be connected to well-known types of electronic circuitry such as automatic termination circuitry activated by reflected light. If the series thyristor 15 begins to be quenched through a counter-current over series thyristor 15 from terminals 49 and 50 then the series thyristor 15 can no longer fire after the quenching pulses have decayed.

Figure 3:
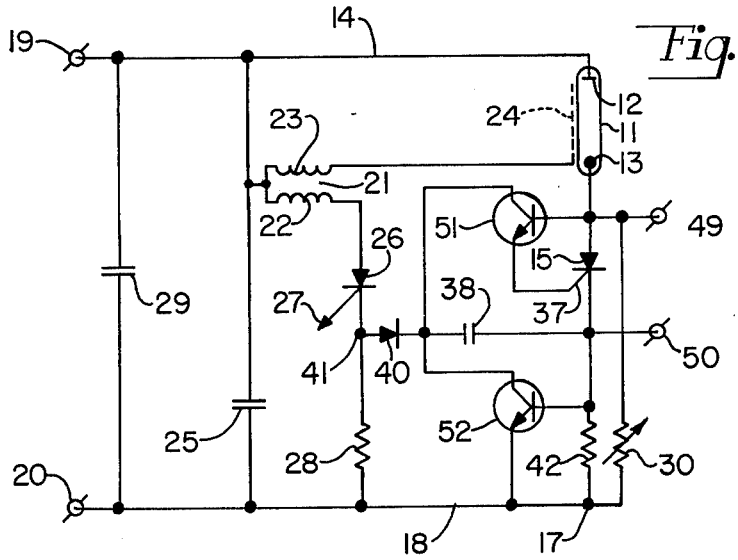
FIG. 3 is a circuit diagram of an ignition arrangement for a flashtube which applys a switching pulse to the gate of a series thyristor at the beginning of the discharge curve of the flashtube current and terminates said switching pulse in response to a predetermined amount of current passing through the flashtube, in accordance with this invention.

Referring now to FIG. 3, a further improvement is shown which incldudes a first threshold switch or transistor 51 connecting the control capacitor 38 with the control electrode or gate 37 of series thyristor 15, when the flashtube current flowing through the metering resistor 30 corresponds to the latching current of the series thyristor 15. At the same time, a second electronic threshold switch or transistor 52 short circuits the control capacitor 38, when the flashtube current in a series resistor 42 exceeds a predetermined discharge current lying above the latching current. Through this arrangement, time is eliminated as a significant variable from the switching process, for the ignition voltage at the control electrode or gate 37 of the series thyristor 15 is solely determined by the conductivity of the plasma in the flashtube 11.

Still referring to FIG. 3, the control condensor 38 is charged up through diode 40 by an ignition pulse in the ignition circuit of the switching thyristor 26, ignition capacitor 25, ignition transformer 21, voltage terminal 41, and resistor 28. When the plasma in the flashtube 11 can generate the latching current of the series thyristor 15, the threshold switch 51 switches the control capacitor 38 to the control electrode or gate 37 of the series thyristor 15. Thus, the series thyristor 15 conducts. The growing discharge current generates a control signal in the series resistor 42 when the current lies above the latching current. This control serves to turn on the threshold switch 52. On its part, the latter now discharges control capacitor 38. If a quenching signal is then conducted over terminal 49 and 50 through series thyristor 15, a new turn on, based on a residual charge in control capacitor 38, can no longer occur. The two threshold switches 51 and 52 thus determine the turn on and turn off point for the control voltage source or control capacitor 38, and they do this from a partial range of the discharge current, namely from its rising portion.

While embodiments and applications have been shown and described, it will be apparent to those still in the art that many more modifications are possible without departing from the inventive concepts herein described.

What is claimed as new and desired to be secured by Letters Patent of the United States is:

1. A circuit for an electronic flashtube comprising:
a series thyristor, having a gate, electrically connected in series with the flashtube;
an ignition circuit including an ignition capacitor and an ignition transformer, said ignition capacitor being electrically connected to said ignition transformer, which in turn is electrically connected to the flashtube;
a control capacitor for applying a control voltage signal to said series thyristor through said gate;
an electronic threshold switch, having a control electrode, electrically connected between said control capacitor and said gate of said series thyristor; and
switching means including impedance means electrically connected between said flashtube and said control electrode of said electronic threshold switch so that current from the flashtube flows through said impedance means and for applying a biasing signal to said control electrode of said electronic threshold switch thereby rendering said electronic threshold switch conductive and thereby applying said control voltage signal from said control capacitor to said series thyristor for a predetermined time after a predetermined current is reached in the flashtube.

2. The circuit as in claim 1 wherein said predetermined current corresponds to the latching current of said series thyristor.

3. The circuit as in claim 1 further including a gate resistor electrically connected between said control capacitor and said gate of said series thyristor wherein the predetermined time is determined by the time constant of said control capacitor.

4. The circuit as in claim 3 wherein said impedance means is an adjustable resistor.

5. A circuit for ane electronic flashtube comprising:
a series thyristor, having a gate, electrically connected in series with the flashtube;
a series resistor means electrically connected in series with said series thyristor at a voltage terminal point;
an ignition circuit including an ignition capacitor and an ignition transformer, said ignition capacitor being electrically connected to said ignition transformer which in turn is electrically connected to the flashtube;
a control capacitor for applying a control voltage signal to said series thyristor through said gate thereby rendering said series thyristor conductive; and
an electronic threshold switch means, having a control electrode, said control electrode of said electronic threshold switch means being electrically connected at said voltage terminal point between said series thyristor and said series resistor means, said electronic threshold switch means electrically shorting said control capacitor when a predetermined amount of current passes through said series resistor means.

6. A circuit for an electronic flashtube comprising:
a series thyristor, having a gate, electrically connected in series with the flashtube at a first voltage terminal point;

a series resistor means electrically connected in series with said series thyristor at a second voltage terminal point;

an ignition circuit including an ignition capacitor and an ignition transformer, said ignition capacitor being electrically connected to said ignition transformer, which in turn is electrically connected to the flashtube;

a control capacitor for applying a control voltage signal to said series thyristor through said gate;

a first electronic threshold switching means having a first control electrode, said first control electrode being electrically connected between said control capacitor and said gate of said series thyristor at said first voltage terminal point;

switching means including impedance means electrically connected between said flashtube at said first voltage terminal point and said first control electrode of said first electronic threshold switching means so that current from the flashtube flows through said impedance means and for applying a biasing signal to said first control electrode of said first electronic threshold switching means and thereby applying said control voltage signal from said control capacitor to said series thyristor in response to a predetermined current level from the flashtube;

and a second electronic threshold switching means, having a second control electrode, said second control electrode being electrically connected at said second voltage terminal point, said second electronic threshold switching means electrically shorting said control capacitor when a predetermined amount of current passes through said series resistor means.

7. The circuit as in claim 6 wherein said predetermined current level corresponds to the latching current of said series thyristor.

8. The circuit as in claim 7 wherein said impedance means is an adjustable resistor.

* * * * *